US005827109A

United States Patent [19]

Krull

[11] Patent Number: 5,827,109

[45] Date of Patent: Oct. 27, 1998

[54] METHOD AND APPARATUS FOR AMUSING YOUNG CHILDREN

[76] Inventor: Mark A. Krull, 1705 E. Ridge Ct., Northfield, Minn. 55057

[21] Appl. No.: 863,055

[22] Filed: May 23, 1997

[51] Int. Cl.[6] ..... A63H 33/18; A63B 37/12; A63B 37/02

[52] U.S. Cl. ..... 446/373; 473/600; 473/607; 473/612

[58] Field of Search ..... 446/369, 370, 446/373, 397, 487; 473/594–600, 607, 614, 612, 613, 157, 163, 167

[56] References Cited

U.S. PATENT DOCUMENTS

| | | | |
|---|---|---|---|
| 2,362,064 | 11/1944 | Giesinger | 473/595 |
| 3,911,617 | 10/1975 | Gelfand | 446/375 |
| 4,756,529 | 7/1988 | Stillinger | 273/58 K |
| 4,826,179 | 5/1989 | Callagahan | 473/613 |
| 4,944,363 | 7/1990 | Osher et al. | 273/58 A |
| 5,027,457 | 7/1991 | Sweet | 446/369 |
| 5,067,925 | 11/1991 | West | 446/397 |
| 5,131,665 | 7/1992 | Myers | 476/600 |
| 5,413,331 | 5/1995 | Stillinger | 273/58 BA |

FOREIGN PATENT DOCUMENTS

| | | | |
|---|---|---|---|
| 16142 | 7/1910 | United Kingdom | 473/167 |

*Primary Examiner*—Robert A. Hafer
*Assistant Examiner*—Laura Fossum

[57] ABSTRACT

An amusement device for young children includes a cloth housing secured about a core such that peripherally distributed portions of the housing are relatively farther from the core and/or peripherally distributed gaps are defined between the housing and the core. In a preferred embodiment, the cloth housing is formed to assume a first geometric shape, which is substantially pyramidal, and the core is formed to assume a second, discrete geometric shape, which is substantially spherical.

11 Claims, 6 Drawing Sheets

Fig. 20
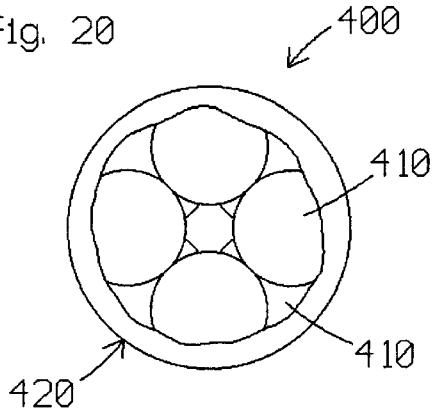
Fig. 21
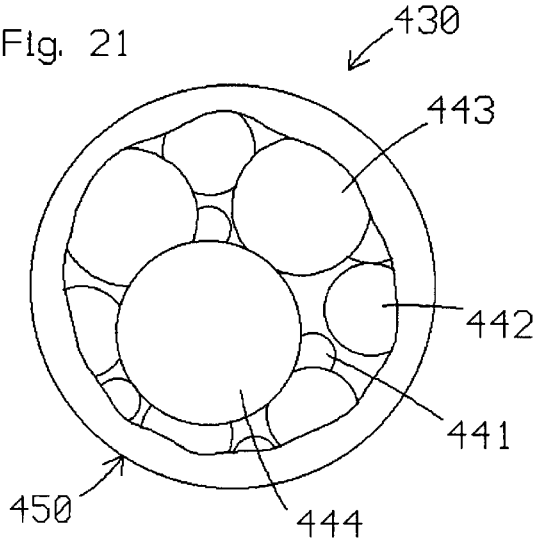
Fig. 22
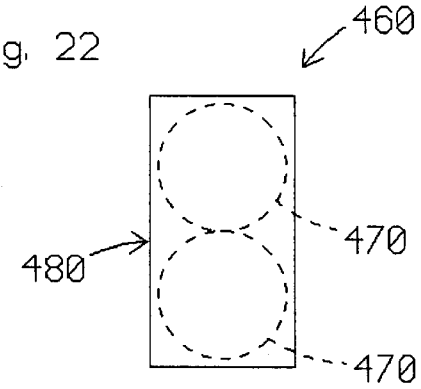
Fig. 23
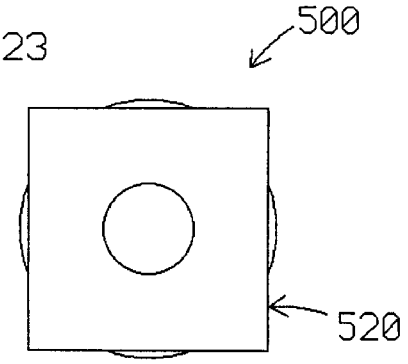
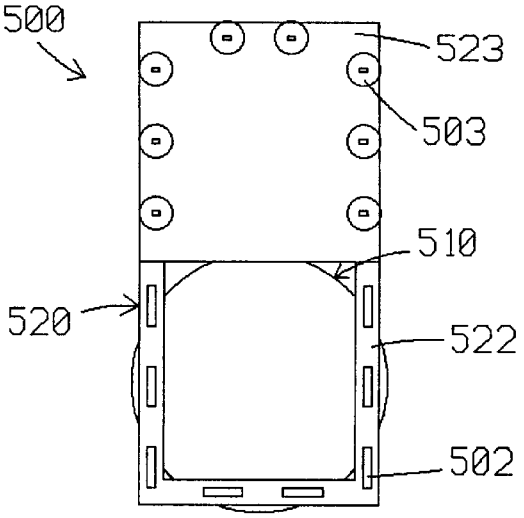
Fig. 24

METHOD AND APPARATUS FOR AMUSING YOUNG CHILDREN

FIELD OF THE INVENTION

The present invention relates to methods and apparatus for occupying the attention of young children and more particularly, to amusement devices having a cloth cover or housing disposed about a core.

BACKGROUND OF THE INVENTION

A variety of methods and apparatus have been devised to occupy the attention of infants and/or contribute to their development. In general, such methods and apparatus tend to place infants in contact with objects in the physical world and/or stimulate one or more of their five senses in a manner that is both safe and entertaining. For example, a pacifier accommodates an infant's desire or instinct to suck; a rattle makes noise in response to movement; and a stuffed toy is pleasant to touch. These sorts of devices are preferably designed to be easily grasped by an infant, but such is not always the case.

An example of one such amusement device which is designed to be relatively easily grasped is shown and described in U.S. Pat. No. 5,551,687. The patented toy has a plurality of cloth tags disposed about the surface of a ball, and the patent discusses the appeal of such tags to infants. However, one shortcoming of the patented toy is that it is relatively costly to manufacture. In particular, both the acquisition of the tags and the labor required to secure them in place on the ball add significantly to the cost of manufacturing the ball. Moreover, some people are inclined to remove manufacturers' tags from baby toys as a safety precaution, although the inventor of both the present invention and the patented toy does not share this predisposition against such tags. In any event, a need exists for amusement devices which are both easy for an infant to grasp and relatively less expensive to manufacture and/or less susceptible to the concerns of safety-conscious parents.

SUMMARY OF THE INVENTION

One aspect of the present invention is to dispose a core within a cloth housing in such a manner that first peripherally distributed portions of the cloth housing and the core are relatively nearer to one another, and second peripherally distributed portions of the cloth housing and the core are relatively farther from one another. The relatively distal, second portions of the cloth housing provide easily grasped "handles" disposed about the perimeter of the housing. Since the handles are integral portions of the housing itself they need not be independently acquired and/or connected to the housing.

One way to provide such handles is to dispose a cloth housing which is predisposed to assume a first discrete geometrical shape, about a core which is predisposed to form a second discrete geometrical shape. For example, a preferred embodiment of the present invention includes a spherical foam core disposed within a pyramidal cloth housing. The spherical core occupies the center of the cloth pyramid but does not extend into any of the corners of the pyramid. In other words, the center of each of the pyramid sides is proximate a discrete portion of the core surface, while the corners of the pyramid are relatively distant from the core. The integral and flexible corner portions not only provide handles which are relatively easy for a young child to grasp, but also cooperate with the core to define gaps suitable for housing amusing objects, such as crinkle paper, bells, beads, etc.

The foregoing embodiment lends itself to various sorts of modifications. For example, the foam core may be replaced by a stuffed member, an inflated member, a molded member, or any other suitable core member; the sides of the cloth housing may be provided with one or more holes which align with one or more "oversized" portions of the core and allow the latter to protrude through the former; and/or the shapes of the first member and/or the second member may be altered. For example, a spherical core may be disposed within a cubical cloth housing; or a cubical core may be disposed within a spherical cloth housing.

Another aspect of the present invention is to interconnect two or more "gapped" portions or handles disposed about the perimeter of a toy. For example, a string may be inserted through the core and interconnected between two diametrically opposite ends of a football-shaped cloth housing. Either of the connected corners may be pulled by hand to a relatively extended position and then subsequently pulled by string to a relatively retracted position (as if by magic from the perspective of a young child). The string is accessible and movable, yet entirely shrouded by the cloth housing and thus, kept out of harm's way.

Another aspect of the present invention is to house a first member, having a first shape and some sort of irregularities disposed about its perimeter, within a second member, having a second, comparable shape. For example, another embodiment of the present invention includes a ball with whiskers disposed within a spherical cloth housing of comparable diameter. A representative sample of such a ball is shown and described in U.S. Pat. No. 4,756,529 to Stillinger. The provision of a flexible cloth housing about numerous resilient bristles or whiskers accommodates grasping and squeezing of the toy and yet, prevents the bristles from posing any sort of hazard to young children.

Yet another embodiment includes a cloth housing disposed about a core with amusing objects, such as beads, bell, rings, etc. secured to the core surface and/or simply disposed between the core surface and the cloth housing. The cloth housing allows sensory interaction with the objects, yet prevents the objects from posing any sort of hazard to young children. Still another embodiment of includes a cloth housing disposed about a molded core having deformations formed in its outer surface. The cloth housing provides a soft cover, and yet, the deformations may nonetheless by felt through the cloth housing.

Yet another aspect of the present invention is to house a first member or core within a relatively larger second member or housing. For example, another embodiment of the present invention includes a spherical foam core, having a first diameter, disposed within a spherical cloth housing, having a second, relatively greater diameter. The "loose-fitting" housing is relatively easy to grasp by a young child. This aspect of the present invention is applicable to many of the foregoing embodiments, as well. Alternatively, by using a stuffed ball for the core, one can sew or otherwise secure portions of the housing to portions of the core, thereby creating "gapped" portions and/or compartments. In any case, one or more amusing objects may be captured between the housing and the core and either secured in place or free to move relative thereto. Also, the oversized housing may be constructed in such a manner that it converts between a loose-fitting configuration and a snug-fitting configuration and/or provides a pocket on the exterior of the toy.

Still another aspect of the present invention is to house a plurality of members within a cloth housing. For example, another embodiment of the present invention includes a cloth housing secured about eight table tennis balls. The light weight of the balls, their hollow construction, and their relatively low friction, outer surfaces all contribute to make the table tennis balls a desirable "core" material. This embodiment lends itself to various sorts of modifications, as well. For example, the housing may be disposed about different sizes of balls and/or relatively smaller beads, buttons, and the like.

A further aspect of the invention is to provide a selectively removable outer cloth housing. For example, an opening in the housing may be sufficient in size to allow passage of the core or other contents, and the opening may be selectively closed by means of buttons, hook and loop fasteners, zippers, or other suitable closures. Additional embodiments and advantages of the present invention will become apparent to those skilled in the art from the more detailed description that follows.

BRIEF DESCRIPTION OF THE FIGURES OF THE DRAWING

With reference to the Figures of the Drawing, wherein like numerals represent like parts and assemblies throughout the several views.

FIG. 20 is a partially sectioned top view of a thirteenth amusement device constructed according to the principles of the present invention;

FIG. 21 is a partially sectioned top view of a fourteenth amusement device constructed according to the principles of the present invention;

FIG. 22 is a side view of a fifteenth amusement device constructed according to the principles of the present invention;

FIG. 23 is a top view of a sixteenth amusement device constructed according to the principles of the present invention, shown in a closed configuration;

FIG. 24 is a top view of the amusement device of FIG. 23, shown in an opened configuration;

DETAILED DESCRIPTION OF A PREFERRED EMBODIMENT

Figure 1:
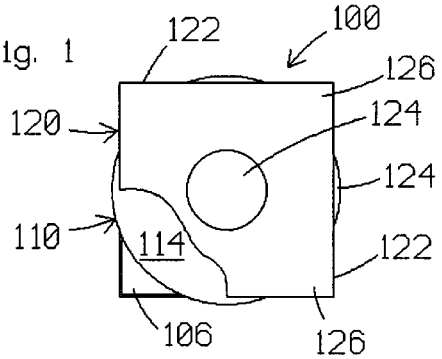
FIG. 1 is a top view of a first amusement device constructed according to the principles of the present invention.
Figure 2:
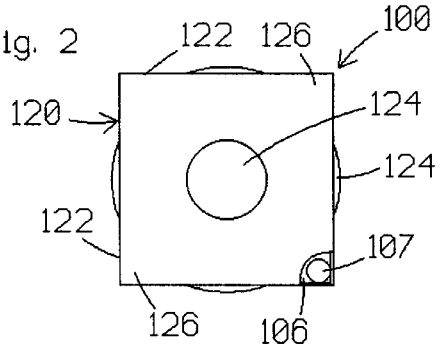
FIG. 2 is a front view of the amusement device of FIG. 1.

A first embodiment of the present invention is designated as 100 in FIGS. 1–2. The amusement device 100 includes a spherical core 110 disposed within a cubical cloth housing 120. In the embodiment 100, the cloth housing 120 has six square sides or cloth segments, each of which is bordered by four straight edges. The segments are sewn to one another along adjacent edges. However, those skilled in the art will recognize that, in the alternative, two or more of the segments may be integral portions of a single piece of cloth, with common edges defined simply by bends or creases in the cloth. Yet, those skilled in the art will also recognize that seams or stitching along the edges tend to more rigidly define or maintain the corners between adjacent segments. In any event, the cloth housing 120 may be said to be formed or predisposed to assume a substantially cubical shape if, for example, it were filled with an amorphous, lightweight stuffing material.

Figure 2A:
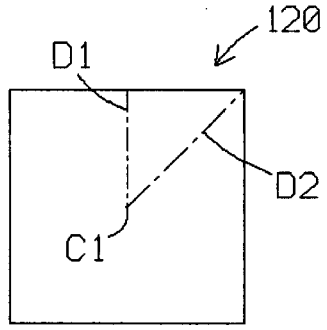
FIG. 2*a* is a front view of a cloth housing forming a part of the amusement device of FIG. 1.

As shown in FIG. 2*a*, the cloth housing 120 defines a substantially cubical shape having a geometric center C1, a first, relatively smaller outside dimension equal to twice the distance D1, and a second, relative larger outside dimension equal to twice the distance D2. The first distance D1 is approximately 1.875 inches, as measured from the geometric center C1 normal to the side of the cube, in a direction parallel to the plane defined by the drawing sheet. The second distance D2 is approximately 3.25 inches, as measured from the geometric center C1 to a corner of the cube, in a direction defining an angle of 45 degrees relative to both the D1 direction and the plane defined by the drawing sheet.

Figure 2B:
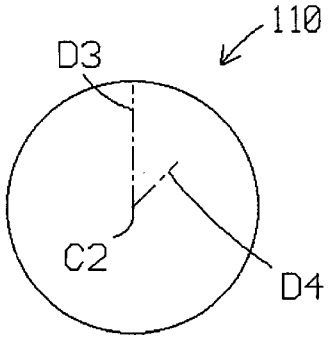
FIG. 2*b* is a front view of a core forming a part of the amusement device of FIG. 1.

In the embodiment 100, the spherical core 110 is made of lightweight, resilient foam. As shown in FIG. 2*b*, the core 110 defines a substantially spherical shape having a geometric center C2, a first outside dimension equal to twice the distance D3, and a second outside dimension equal to twice the distance D4. The distances D3 and D4 are discrete radii of the sphere and thus, by definition, are equal to one another. The first distance D3 is approximately two inches, as measured from the geometric center C2 normal to the outer surface of the sphere, in a direction parallel to the plane defined by the drawing sheet. The second distance D4 is approximately two inches, as measured from the geometric center C2 to the outer surface of the sphere, in a direction defining an angle of 45 degrees relative to both the D3 direction and the plane defined by the drawing sheet. In other words, the measurements D1 and D3 are taken in the same direction, and the dimensions D2 and D4 are taken in the same direction.

The relative sizes and configurations of the core 110 and the cloth housing 120 are such that the predisposed spherical dimensions of the core 110 do not fit within the predisposed cubical dimensions of the cloth housing 120 (because D3>D1). However, the core 110 is nonetheless enclosed within the flexible cloth housing 120. In the embodiment 100, the accommodating nature of both the core 110 and the cloth housing 120 compensates for the dimensional interference, and the shape of each member influences that of the other. In particular, when the geometric centers C1 and C2 are approximately coincidental, the core 110 is compressed between central portions 124 of the sides of the housing 120, and the core 110 causes these central portions 124 to bulge outward and conform to the outer surface 114 of the compressed core 110. These "touching" portions of the core 110 and the housing 120 may be said to be peripherally distributed about the geometric center of the toy 100.

In instances where the core 110 is "oversized" relative to the cloth housing 120, the extent to which each member changes shape is a function of the members' relative elasticities. If the core 110 were rigid, for example, then the cloth housing 120 must stretch enough to accommodate the spherical shape of the core 110. On the other hand, if the cloth housing 120 were incapable of stretching, then the core would have to compress enough to fit within the cloth housing 120.

When the geometric centers C1 and C2 are aligned, none of the corners 126 of the housing 120 fits snugly over the outer surface 114 of the core 110 (because D2>D4), and thus, each of the corners 126 remains relatively loose and well suited for grasping. The corners 126 also cooperate with the outer surface 114 of the core 110 to define gaps or compartments 106. As used herein, the term "gap" is intended to mean an enclosed space having three orthogonal dimensions which are greater than zero. In other words, the term "gap" should be construed to require something more than simply a pocket or interface between adjacent surfaces. For example, at least one of the adjacent surfaces must be capable of loosely extending in "bunched" or indirect fashion relative to the other adjacent surface in order to constitute a "gap" as that term is used herein.

One or more amusing objects 107, such as crinkle paper, bells, rattles, beads, rings, or any other suitable member, may be disposed within one or more of the eight gaps 106. As used herein, the term "amusing object" is intended to mean a discrete element which contrasts (in rigidity, texture, and/or function) with the other recited elements. In other words, the term "amusing object" should be construed to require something more than simply a portion of the stuffing material or a portion of the cloth housing. For example, a discrete element must be added to the cloth housing and/or the core in order to constitute an "amusing object" as that term is used herein.

Figure 3:
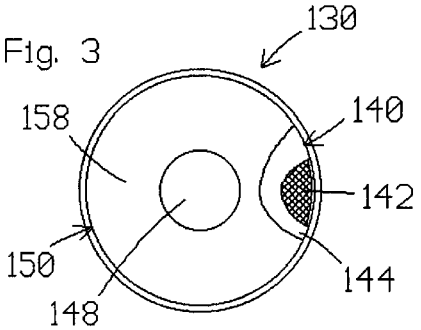
FIG. 3 is a top view of a second amusement device constructed according to the principles of the present invention.
Figure 4:
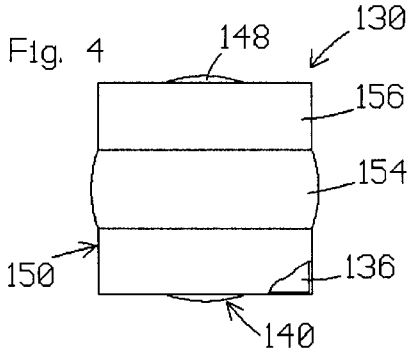
FIG. 4 is a front view of the amusement device of FIG. 3.

The foregoing embodiment 100 lends itself to various sorts of improvements and/or modifications. For example, the foam core may be replaced by a stuffed core, an inflated core, a molded core, or any other suitable core member; one or more sides of the cloth housing may be provided with a hole which aligns with an "oversized" portion of the core and allows the latter to protrude through the former; and/or the shapes of the first member and/or the second member may be altered. An example of each of these variations is incorporated into the amusement device designated as 130 in FIGS. 3–4.

The device 130 includes a spherical core 140 disposed within a cylindrical cloth housing 150. The cloth housing 150 has two circular ends 158 and a cylindrical side wall 156 secured therebetween by stitching. The cloth housing 150 may be said to be formed or predisposed to assume a substantially cylindrical shape if filled with an amorphous, lightweight stuffing material.

Figure 4A:
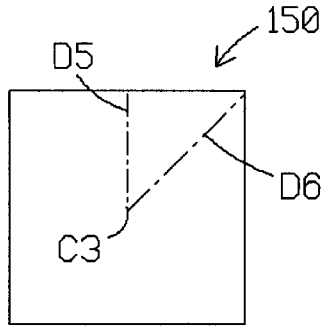
FIG. 4*a* is a front view of a cloth housing forming a part of the amusement device of FIG. 3.

As shown in FIG. 4*a*, the cloth housing 150 defines a cylindrical shape having a geometric center C3, a first, relatively smaller outside dimension equal to twice the distance D5, and a second, relative larger outside dimension equal to twice the distance D6. The first distance D5 is measured from the geometric center C3 normal to an end of the cylinder, in a direction parallel to the plane defined by the drawing sheet. The second distance D6 is measured from the geometric center C3 to an edge of the cylinder sidewall, in a direction defining an angle of 45 degrees relative to the D5 direction.

Figure 4B:
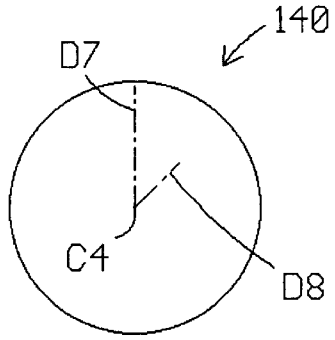
FIG. 4*b* is a front view of a core forming a part of the amusement device of FIG. 3.

The spherical core 140 includes an amorphous, lightweight stuffing material 142 disposed within a spherical cloth housing 144. As shown in FIG. 4*b*, the resulting core 140 defines a spherical shape having a geometric center C4, a first outside dimension equal to twice the distance D7, and a second outside dimension equal to twice the distance D8. The distances D7 and D8 are discrete radii of the sphere and thus, by definition, are equal to one another. The first distance D7 is measured from the geometric center C4 normal to the outer surface of the sphere, in a direction parallel to the plane defined by the drawing sheet itself. The second distance D8 is measured from the geometric center C4 to the outer surface of the sphere, in a direction defining an angle of 45 degrees relative to the D3 direction. In other words, the dimensions D5 and D7 are measured in the same direction, and the dimensions D6 and D8 are measured in the same direction.

The relative sizes and configurations of the core 140 and the cloth housing 150 are such that the predisposed spherical dimensions of the core 140 do not fit within the predisposed cylindrical dimensions of the cloth housing 150 (because D7>D5, and also, because D7 is greater than the radius of the cylindrical sidewall). However, the core 140 is nonetheless disposed within the flexible cloth housing 150. Circular holes are provided in the end walls 158 of the cylindrical housing 150 to accommodate, and expose, protruding portions 148 of the core 140, and the core 140 causes an intermediate portion 154 of the sidewall 156 to bulge outward and assume a toroidal shape. The overall shape of the resulting device 130 is such that it remains relatively free to roll back and forth in a particular direction. Each end wall 158 of the housing 150 cooperates with a respective portion of the sidewall 156 to define an annular handle or loose fitting section on the housing 150. Each such handle cooperates with the core housing 144 to define an annular compartment 136 at each end of the device 130. One or more amusing objects may be disposed within either or both of the compartments 136.

Figure 5:
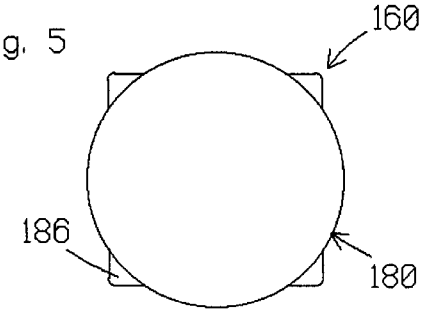
FIG. 5 is a top view of a third amusement device constructed according to the principles of the present invention.
Figure 6:
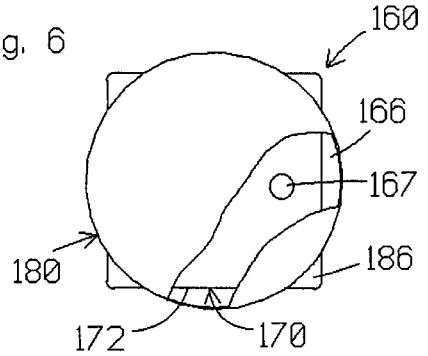
FIG. 6 is a front view of the amusement device of FIG. 5.
Figure 6A:
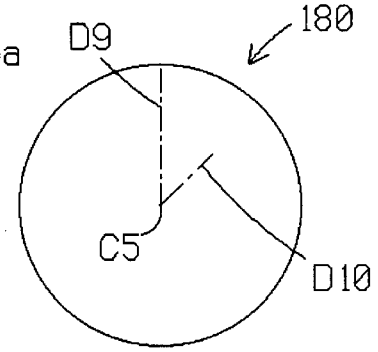
FIG. 6*a* is a front view of a cloth housing forming a part of the amusement device of FIG. 5.
Figure 6B:
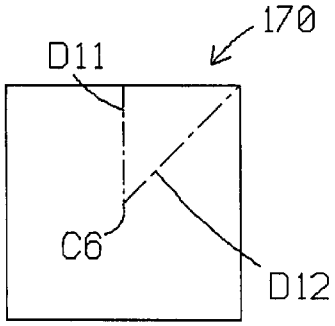
FIG. 6*b* is a front view of a core forming a part of the amusement device of FIG. 5.

FIGS. 5–6 show an amusement device 160 which includes a cubical core 170 disposed within a spherical cloth housing 180. The diameter of the housing 180 is longer than the edges 172 of the core 170 (compare dimensions D9 and D11 in FIGS. 6*a* and 6*b*) but shorter than the distance between diametrically opposed corners of the core 170 (compare dimensions D10 and D12 in FIGS. 6*a* and 6*b*). As with the other embodiments, the core 170 is nonetheless disposed within the cloth housing 180 in such a manner that first peripherally distributed portions of each are relatively nearer to one another, and second peripherally distribute portions of each are relatively farther from one another. In particular, when the geometric centers C5 and C6 are substantially aligned, the eight corners of the core 170 cause the housing 180 to bulge (see 186 in FIGS. 5 and 6), while the housing 180 compresses or rounds each of the corners of the core 170 somewhat. The shapes of the core 170 and the housing 180 also cooperate to a continuous, three dimensional gap or compartment 166 which occupies a substantially cross-shaped configuration relative to each side of the core 170. At least one small ball 167 (or other suitable object) may be placed in the gap 166 and moved through a continuous path relative to the core 170 and the housing 180.

Figure 7:
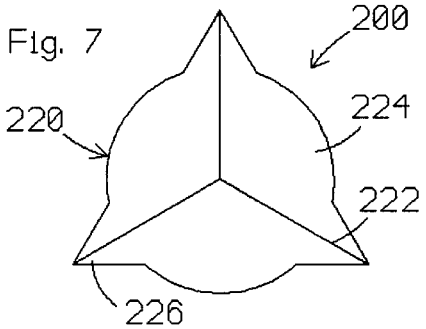
FIG. 7 is a top view of a fourth amusement device constructed according to the principles of the present invention.
Figure 8:
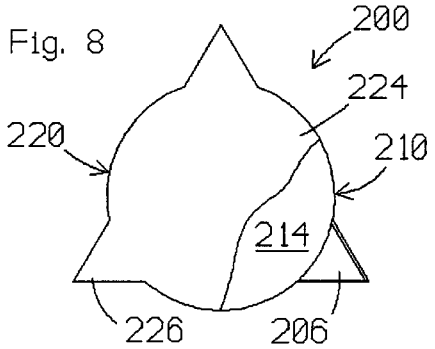
FIG. 8 is a front view of the amusement device of FIG. 7.

A preferred embodiment of the present invention is designated as 200 in FIGS. 7–8. The amusement device 200 includes a spherical core 210 disposed within a four-sided pyramidal housing 220. The cloth housing 220 has four triangular sides or cloth segments, each of which is bordered by three straight, equal length edges. The segments are sewn to one another along adjacent edges. However, those skilled in the art will recognize that, in the alternative, some of the segments may be integral portions of a single piece of cloth, with common edges defined simply by bends or creases in the cloth. Yet, those skilled in the art will also recognize that seams or stitching along the edges tend to more rigidly define or maintain the corners between adjacent segments. In any event, the cloth housing 220 may be said to be formed or predisposed to assume a substantially pyramidal shape if filled with an amorphous, lightweight stuffing material.

Figure 8A:
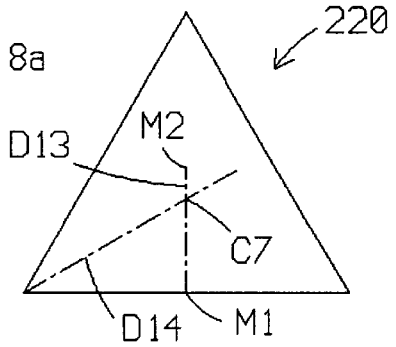
FIG. 8*a* is a front view of a cloth housing forming a part of the amusement device of FIG. 7.

As shown in FIG. 8*a*, the cloth housing 220 defines a pyramidal shape having a geometric center C7, a first, relatively smaller outside dimension D13, and a second, relative larger outside dimension D14. The first dimension D13 may be described as the length of a line extending from the midpoint M1 of a first edge to the midpoint M2 of a second edge which extends perpendicular to the first edge. The second dimension D14 may be described as the height of the pyramid, as measured from any corner to the center of the side opposite the corner.

Figure 8B:
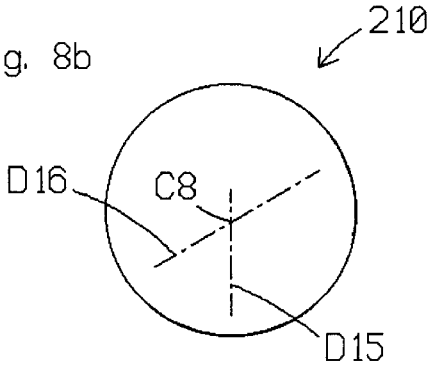
FIG. 8*b* is a front view of a core forming a part of the amusement device of FIG. 7.

The spherical core 210 is made of lightweight and resilient foam. As shown in FIG. 8*b*, the core 210 defines a spherical shape having a geometric center C8, a first outside dimension D15, and a second outside dimension D16. The dimensions D3 and D4 are discrete diameters of the sphere and thus, by definition, are equal to one another. The first dimension D15 is measured from the geometric center C8 normal to the outer surface of the sphere, in the same direction as the dimension D13. The second dimension D16 is measured from the geometric center C8 normal to the outer surface of the sphere, in the same direction as dimension D14.

In the preferred embodiment 200, the diameter of the core 210 is approximately four inches, and the length of each edge 222 of the cloth housing 220 is approximately six inches. The relative sizes and configurations of the core 210 and the cloth housing 220 are such that the predisposed spherical dimensions of the core 210 do not fit within the predisposed pyramidal dimensions of the cloth housing 220. However, the core 210 is nonetheless enclosed within the flexible cloth housing 220 in such a manner that the geometric centers C7 and C8 substantially coincide. Centered and compressed within the housing 220, the core 210 causes the housing 220 to bulge at a central portion 224 of each of the four sides, while leaving relatively pronounced loose portions or handles at each of the four corners 226. The corners or handles 226 extend generally away from the outer surface 214 of the core 210 and cooperate therewith to define compartments 206.

One option with the embodiment 200 is to place a different amusing object in each of the compartments 206. For example, a piece of crinkle paper may be placed in a first compartment; a "clicking" toy may be placed in a second compartment; a bell may be placed in a third compartment; and a "squeaking" toy may be placed in the fourth compartment. If each side of the cloth housing 220 is made with a material of different color and/or texture, games may be played in seeking out and/or remembering where each noise making toy is located relative to the discrete sides.

In the absence of amusing objects in the corners, the devices with spherical cores react like a spherical ball in some respects, despite the "pointed" corners. For example, such devices may be batted about much like a spherical ball because the corners offer little resistance to bending and/or collapsing. Also, the devices with foam cores may be rolled about, because they are relatively "bouncy" and lightweight, though they do not tend to travel in as straight as path as a spherical ball.

Figure 9:
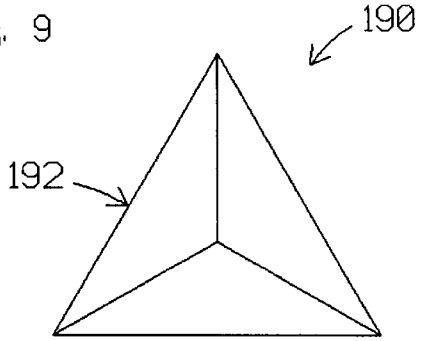
FIG. 9 is a top view of a fifth amusement device constructed according to the principles of the present invention.
Figure 10:
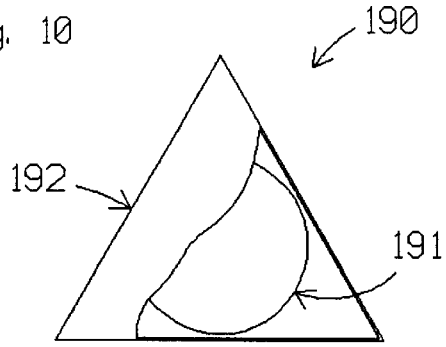
FIG. 10 is a partially sectioned front view of the amusement device of FIG. 9.

Another embodiment of the present invention is designated as 190 in FIGS. 9–10. Like the preferred embodiment 200, the amusement device 190 includes a spherical core 191 disposed within a pyramidal cloth housing 192. However, unlike the preferred embodiment 200, the housing 192 has predisposed dimensions which are sufficient in size to accommodate the predisposed dimensions of the core 191. When the geometric centers are aligned, the core 191 is within one-quarter inch of the center of each side of the housing 192. The core 191 and the housing 192 may nonetheless be said to have first peripherally distributed portions which are relatively close and second peripherally distributed portions which are relatively distant, though in this case, close does not necessarily require contact.

Figure 11:
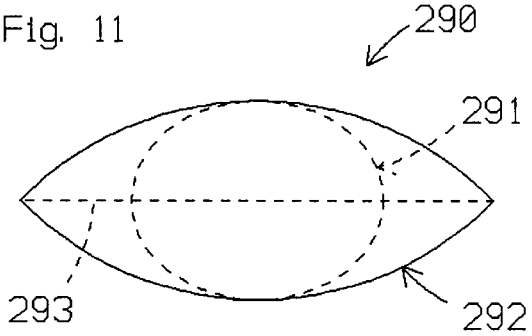
FIG. 11 is a side view of a sixth amusement device constructed according to the principles of the present invention.
Figure 12:
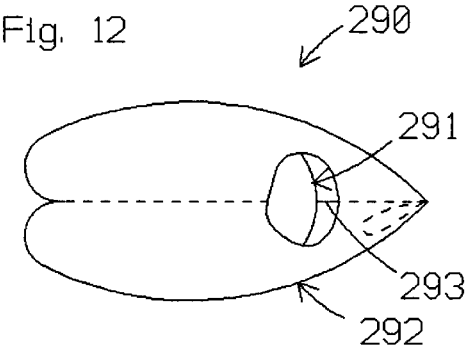
FIG. 12 is a partially sectioned side view of the amusement device of FIG. 11.

Another embodiment of the present invention is designated as 290 in FIGS. 11–12. The amusement device 290 includes an ellipsoidal core 291 disposed within a football-shaped cloth housing 292. A string 293 extends through the core 291 and is interconnected between opposite ends of the housing 292. The length of the string 233 is equal to the length of the cloth housing 292. Either of the ends of the housing 292 may be pulled by hand to a relatively extended position and then subsequently pulled by string 293 to a relatively retracted position (as if by magic from the perspective of a young child). The string 233 is accessible and movable, yet entirely shrouded by the cloth housing 292 and thus, kept out of harm's way.

Figure 13:
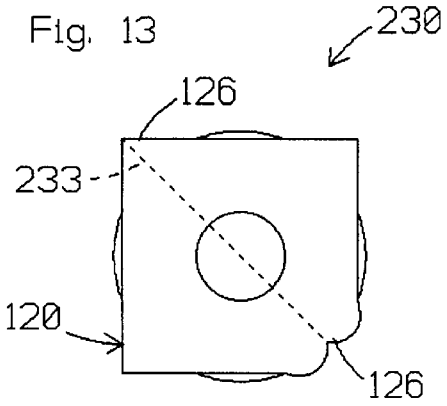
FIG. 13 is a top view of a seventh amusement device constructed according to the principles of the present invention.
Figure 14:
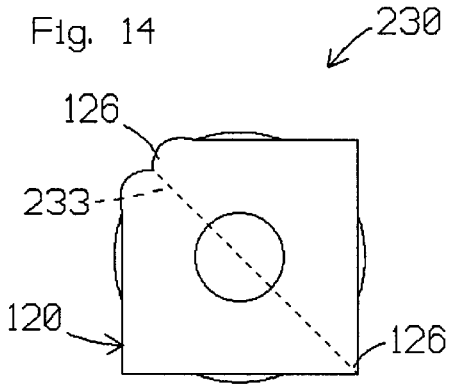
FIG. 14 is a bottom view of the amusement device of FIG. 13.

Another embodiment of the present invention is designated as 230 in FIGS. 13–14. The amusement device 230 is similar in configuration to the device 100 shown and described with reference to FIGS. 1–2 and further includes a string 233 like that of the previous embodiment 290. The string 233 is inserted through the core 110 and interconnected between diametrically opposed corners 126 of the cloth housing 120 (extending at an angle of 45 degrees relative to the drawing sheet). The length of the string 233 is equal to the diameter of the core 110 plus the distance between the core surface 114 and an outstretched corner 126 of the cloth housing 120. Either of the connected corners 126 may be pulled by hand to a relatively extended position and then subsequently pulled by string 233 to a relatively retracted position (as if by magic from the perspective of a young child). During manufacture, the string 233 may be left longer, and/or an end may protrude outside the housing 120, to facilitate sewing and assembly of the device 230; and then, the string 233 may subsequently be cut to the desired length and sewn in place as part of the final closure operation.

Figure 15:
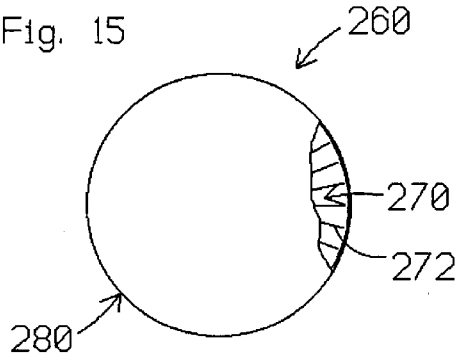
FIG. 15 is a partially sectioned top view of an eighth amusement device constructed according to the principles of the present invention.

Another embodiment of the present invention is designated as 260 in FIG. 15. The amusement device 260 includes a bristle-bearing ball 270 disposed within a spherical cloth housing 280 of comparable diameter. U.S. Pat. No. 4,756,529 to Stillinger discloses the bristle-bearing ball 270 and is incorporated herein by reference. In general, the bristle-bearing ball 270 has resilient bristles or whiskers 272 which extend in substantially all directions from a center. The bristles 272 have distal ends which cooperate to define an outer surface that is generally spherical, but with intermittent gaps or irregularities between the bristles 272. The bristles 272 provide an appealing touch experience, through the cloth housing 280, and yet, the cloth housing 280 prevents the bristles 272 from posing any sort of hazard to young children. Another bristle-bearing ball suitable for use as a core in accordance with the present invention has relatively more rigid bristles with are shaped somewhat like golf tees. Both such balls are sold by OddzOn Products, Inc. of Campbell, Calif., under the brand name KOOSH. In either embodiment, as a child grows older, the cloth housing may be removed to provide the child with a seemingly new toy. In this regard, the present invention may be seen to provide a method of converting a toy suitable for relatively older children into a toy suitable for relatively younger children, and vice versa.

Figure 16:
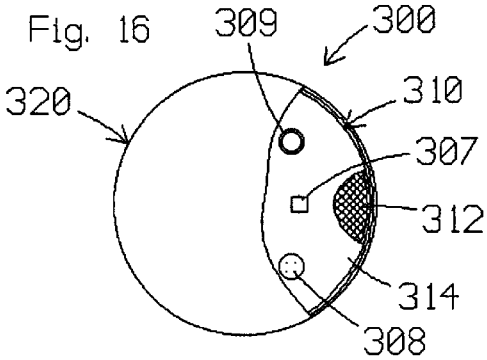
FIG. 16 is a partially sectioned top view of an ninth amusement device constructed according to the principles of the present invention.

Another embodiment of the present invention is designated as 300 in FIG. 16. The amusement device 300 includes a substantially spherical core 310 disposed within a substantially spherical cloth housing 320 of comparable diameter. The core 310 includes an amorphous, lightweight stuffing material 312 disposed within a substantially spherical cloth housing 314. Amusing objects, such as beads 307, buttons 308, rings 309, and/or other suitable members, are secured to the housing or surface 314 of the core 310. In the alternative, one or more amusing objects may be loosely retained between the core surface 314 and the cloth housing 320. The cloth housing 320 allows sensory interaction with the objects, yet prevents the relatively small objects from posing any sort of hazard to young children.

Figure 17:
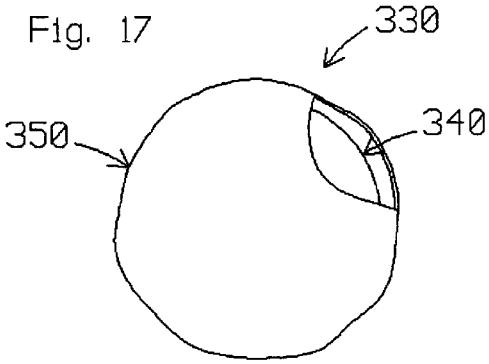
FIG. 17 is a partially sectioned top view of a tenth amusement device constructed according to the principles of the present invention.

Another embodiment of the present invention is designated as 330 in FIG. 17. The amusement device 330 includes a substantially spherical, foam core 340 disposed within a substantially spherical cloth housing 350 having a relatively larger diameter. The "loose-fitting" housing 350 is relatively easy to grasp by a young child. This aspect of the present invention may be applicable to many of the other embodiments, as well.

Figure 18:
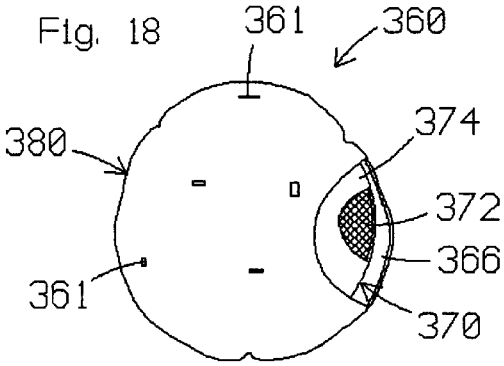
FIG. 18 is a partially sectioned top view of an eleventh amusement device constructed according to the principles of the present invention.
Figure 25:
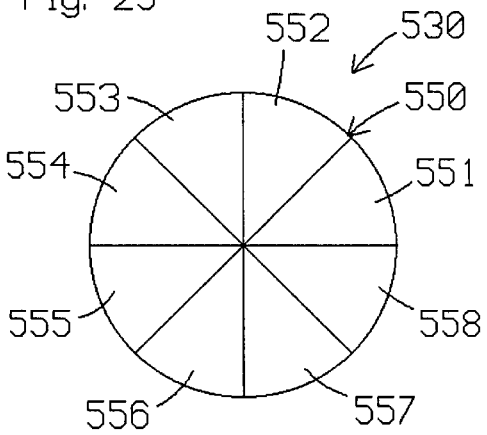
FIG. 25 is a top view of a seventeenth amusement device constructed according to the principles of the present invention, shown in a relatively loose configuration.

Another embodiment of the present invention is designated as 360 in FIG. 18. Like the embodiment 330 of the foregoing paragraph, the amusement device 360 includes a substantially spherical core 370 disposed within a substantially spherical cloth housing 380 having a relatively larger diameter. However, on this embodiment 360, the core 370 is a stuffed member (having a stuffing 372 disposed within a cloth housing 374), and discrete portions of the housing 380 are sewn (by stitching 361) to discrete portions of the core 370, thereby creating "gapped" or "puffed" portions and/or a continuous, serpentine compartment 366. Again, amusing objects may be disposed between the cloth housing 380 and the core 370.

Figure 19:
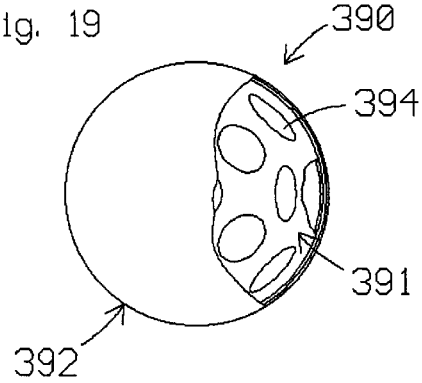
FIG. 19 is a partially sectioned top view of a twelfth amusement device constructed according to the principles of the present invention.

Another embodiment of the present invention is designated as 390 in FIG. 19. The amusement device 390 includes a substantially spherical core 391 disposed within a substantially spherical cloth housing 392 of comparable diameter. The core 391 is a molded ball having irregularities or recesses 394 formed in its surface. The cloth housing 392 provides a soft outer cover yet allows sensory interaction with the irregularities 394 beneath the cover.

Another embodiment of the present invention is designated as 400 in FIG. 20. The amusement device 400 includes eight substantially spherical core members 410 disposed within a substantially spherical cloth housing 420 having a diameter sufficiently large to accommodate the core members 410. In this embodiment 400, the core members 410 are table tennis balls and thus, are relatively lightweight and easy to move relative to the housing 420 and/or one another. The size of the housing 420 is such that it takes on a bulbous appearance when "stuffed" with the balls 410. Those skilled in the art will recognize that other sorts of balls may be substituted for the table tennis balls.

Another embodiment of the present invention is designated as 430 in FIG. 21. The amusement device 430 includes a plurality of substantially spherical core members 440 disposed within a substantially spherical cloth housing 450 having a diameter sufficiently large to accommodate the core members 440. In this embodiment, the core members 440 are injected molded plastic balls of various sizes. Objects of different shapes may be placed inside the housing 450, as well. Again, those skilled in the art will recognize that other sorts of balls may be substituted for the molded plastic balls.

Another embodiment of the present invention is designated as 460 in FIG. 22. The amusement device 460 includes a pair of substantially spherical core members 470 disposed within a substantially cylindrical cloth housing 480 having a height and diameter sufficiently large to accommodate the core members 470. In this embodiment, the core members 470 are racquetballs which snugly fit within the housing 480. The device 460 provides relatively loose-fitting handles in the middle and at each end, and it is relatively free to roll back and forth in one direction. Again, those skilled in the art will recognize that other sorts of balls may be substituted for the particular balls used in this example.

Another embodiment of the present invention is designated as 500 in FIGS. 23–24. Like the embodiment 100 of FIGS. 1–2, the amusement device 500 includes a substantially spherical core 510 disposed within a substantially cubical cloth housing 520. However, this embodiment 500 is not sewn shut about all edges. Rather, a top panel 523 of the housing 520 is free to open and close relative to the remainder of the housing 520. Slots 502 are formed in inwardly extending flaps 522 to receive buttons 503 secured to the inside of the top panel 523. The button arrangement is such that a parent could remove the core 510 from the housing 520, but a young child could not. Other means for fastening the top panel 523, such as hook and loop fasteners or zippers, could be used in lieu of the buttons 503 and slots 502.

Figure 27:
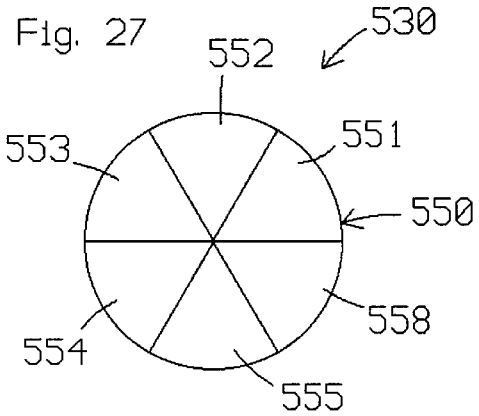
FIG. 27 is a top view of the amusement device of FIG. 25, shown in a folded configuration.
Figure 26:
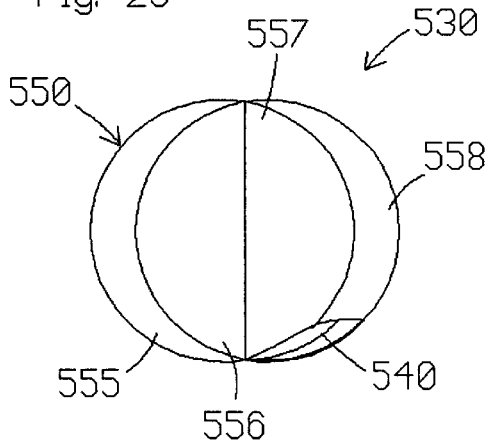
FIG. 26 is a partially sectioned front view of the amusement device of FIG. 25, shown in the same relatively loose configuration.
Figure 28:
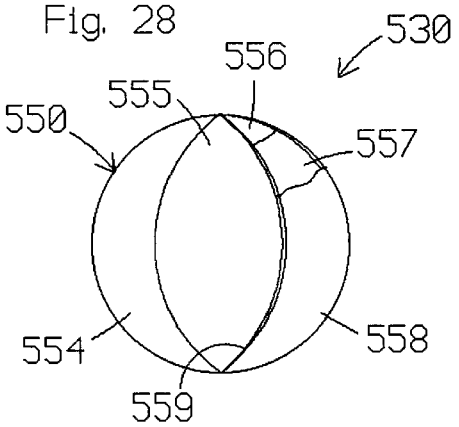
FIG. 28 is a partially sectioned front view of the amusement device of FIG. 25, shown in the same folded configuration as in FIG. 26.

Another embodiment of the present invention is designated as 530 in FIGS. 25–28. The amusement device 530 includes a substantially spherical foam core 540 disposed within a substantially spheroidal cloth housing 550 having a comparable diameter, as measured in a first direction (vertically in FIG. 26), and a relatively larger diameter, as measured in a second, orthogonal direction (horizontally in FIG. 26). The cloth housing includes eight cloth segments 551–558. As shown in FIGS. 27–28, each of the cloth segments 551–558 is sized and configured to define approximately one-sixth of a spherical surface, with allowances made for seams, and each is bounded by opposite, outwardly convex edges which extend from a first common end to a second common end. The cloth segments 551–558 are arranged side by side, and adjacent convex edges are sewn to one another to form the loose-fitting, substantially ellipsoidal cloth housing 550 shown in FIGS. 25–26. Any two adjacent cloth segments (in this case, segments 556 and 557) are selectively foldable relative to one another and beneath an adjacent third cloth segment (in this case, segment 558) to selectively eliminate the gaps between the cloth housing 550 and the outer surface of the core 540, form a pocket 559 which is accessible from outside the cloth housing 550, and make the cloth housing 550 substantially spherical. In other words, the device 530 is selectively convertible to a second configuration, wherein the cloth housing 550 fits snugly about the spherical core 540.

Throughout this document, the term "cloth housing" has been used with the intention that it describe a relatively flexible enclosure which will assume a particular shape if supported by a lightweight, amorphous stuffing material, but which houses a core instead. In other words, the term "cloth housing" does not describe an element which remains relatively rigid in a particular predisposed shape either in the absence of a stuffing material or core, or when disposed about a core of a discrete shape. Thus, if a stuffing material or other stiffener is disposed between two layers of cloth, then the resulting combination does not constitute a "cloth housing" as that term is used herein. The term "core" has been used throughout the foregoing description with the intention that it describe a generally solid element which is predisposed to assume a particular three-dimensional shape. In other words, the term "core" requires something more than simply an amorphous stuffing material and thus, should not be construed as being synonymous therewith. Thus, if a stuffing material is disposed inside a cloth housing, then the resulting combination constitutes a "core" as that term is used herein.

With reference to the foregoing embodiments, the present invention may also be seen to provide methods of making amusement devices for young children. For example, many of the embodiments of the present invention are preferably made by forming a core to assume a first shape; sewing a portion of a cloth housing to assume a second, discrete shape, while leaving a remainder of the housing unsewn to allow passage of the core into the housing; inserting the core into the housing; and sewing the remainder of the housing to assume the second, discrete shape and to retain the core within the housing. Any amusing objects to be added are positioned and/or secured in place (depending on the desired arrangement) prior to sewing the remainder of the housing.

Those skilled in the art will also recognize that to the extent the foregoing embodiments are amusing to children, they may also be seen to facilitate methods for amusing children in accordance with the present invention. For example, a game may be played with the embodiment 200 of FIGS. 7–8, wherein the child is encouraged to remember which corner of the device 200 produces which noise. Those skilled in the art will further recognize that the relatively precise edges and sharp corners shown on many of the embodiments herein are not likely to be so precise and/or sharp on actual products constructed according to the principles of the present invention, due to the nature of the cloth from which they are formed. In this regard, the drawings are merely intended to provide context for explaining some of the embodiments and/or features of the present invention.

For reasons of practicality, the foregoing description and accompanying figures are limited to only a few of the possible embodiments to be constructed in accordance with the principles of the present invention. Recognizing that those skilled in the art will undoubtedly recognize additional embodiments and/or improvements, the scope of the present invention is to be limited only to the extent of the following claims.

What is claimed is:

1. A toy ball, comprising:

a core having a shape which substantially resembles a first geometric solid; and a flexible cloth housing predisposed to assume a shape which substantially resembles a second geometric solid, wherein one of said first geometric solid and said second geometric solid is bounded by curved surfaces, and the other of said first geometric solid and said second geometric solid is bounded by all planar surfaces, and said core is enclosed within said housing, and first peripherally distributed portions of said housing bear against said core, and second peripherally distributed portions of said housing are spaced apart from said core and cooperate therewith to define gaps therebetween.

2. The toy ball of claim 1, wherein said first geometric solid is a sphere.

3. The toy ball of claim 2, wherein said second geometric solid is a pyramid.

4. The toy ball of claim 3, further comprising an amusing object disposed within one of said gaps.

5. The toy ball of claim 1, further comprising an amusing object disposed within one of said gaps.

6. The toy ball of claim 1, wherein each of said gaps is isolated from other said gaps by said first peripherally distributed portions of said housing.

7. A toy ball, comprising:

a flexible cloth housing predisposed to assume a polyhedral shape with all sides being substantially planar and having generally pointed corners; and a substantially spherical core disposed inside said housing, wherein a central portion of each of said sides bears against said core, and each of said corners is spaced apart from said core and cooperates therewith to define a discrete gap therebetween.

8. The toy ball of claim 7, wherein said polyhedral shape is a pyramid.

9. The toy ball of claim 8, further comprising an amusing object disposed within at least one said gap.

10. The toy ball of claim 7, further comprising an amusing object disposed within at least one said gap.

11. The toy ball of claim 7, further comprising a discrete amusing object disposed within each said gap.

* * * * *